US010323465B2

(12) United States Patent
Chen et al.

(10) Patent No.: US 10,323,465 B2
(45) Date of Patent: Jun. 18, 2019

(54) OPTIMIZATION OF ROLLING ELEMENTS ON DRILL BITS

(71) Applicant: HALLIBURTON ENERGY SERVICES, INC., Houston, TX (US)

(72) Inventors: Shilin Chen, Montgomery, TX (US); Robert W. Arfele, Magnolia, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/756,541

(22) PCT Filed: Jun. 15, 2017

(86) PCT No.: PCT/US2017/037799
§ 371 (c)(1),
(2) Date: Feb. 28, 2018

(87) PCT Pub. No.: WO2018/231240
PCT Pub. Date: Dec. 20, 2018

(65) Prior Publication Data

US 2019/0032419 A1 Jan. 31, 2019

(51) Int. Cl.
*E21B 10/42* (2006.01)
*E21B 12/00* (2006.01)
*E21B 10/567* (2006.01)

(52) U.S. Cl.
CPC ..... *E21B 12/00* (2013.01); *E21B 10/42* (2013.01); *E21B 10/567* (2013.01)

(58) Field of Classification Search
CPC ..... E21B 12/00
See application file for complete search history.

(56) References Cited

U.S. PATENT DOCUMENTS 8,863,860 B2 10/2014 Chen et al.
2010/0025119 A1 2/2010 Stauffer
2010/0211362 A1 8/2010 Huang et al.
(Continued)

FOREIGN PATENT DOCUMENTS

WO WO-2016153499 A1 9/2016

OTHER PUBLICATIONS

Korean Intellectual Property Office, PCT/US2017/037799, International Search Report and Written Opinion, dated Nov. 29, 2017, 12 Pages, Korea.

*Primary Examiner* — Manuel A Rivera Vargas

(57) ABSTRACT

A drill bit includes a bit body having cutters and a generally cylindrical rolling element secured thereon. The rolling element protrudes from the bit body to engage a geologic formation. The location and orientation of the rolling element may be selected such that an outer surface of the rolling element maintains multiple points of contact with the geologic formation to balance the operational forces acting thereon for a desired minimum depth of cut. A moment acting on the rolling element may be minimized to thereby prevent damage to the drill bit. A method for configuring the rolling element may include calculating a critical depth of cut for each point along a radial interval defined by the cylindrical body, changing a design variable, and recalculating the critical depth of cut until at least three contact points exist along the rolling element for a desired minimum depth of cut for the interval.

18 Claims, 10 Drawing Sheets

(56) References Cited

U.S. PATENT DOCUMENTS

| | | | | |
|---|---|---|---|---|
| 2016/0153243 | A1* | 6/2016 | Hinz | E21B 10/43 175/57 |
| 2016/0273273 | A1 | 9/2016 | Hinz et al. | |
| 2017/0081922 | A1* | 3/2017 | Chen | E21B 10/43 |
| 2018/0195351 | A1* | 7/2018 | Grosz | E21B 10/43 |

* cited by examiner

OPTIMIZATION OF ROLLING ELEMENTS ON DRILL BITS

CROSS-REFERENCE TO RELATED APPLICATIONS

This application is a U.S. national stage patent application of International Patent Application No. PCT/US2017/037799, filed on Jun. 15, 2017, the benefit of which is claimed and the disclosure of which is incorporated herein by reference in its entirety.

BACKGROUND

In wellbore drilling for the oil and gas industry, a drill bit may be mounted on the end of a drill string and rotated to break up a geologic formation. The drill bit may be rotated by turning the entire drill string, e.g., with a top drive at surface location, and/or the drill bit may be rotated using downhole equipment, such as a mud motor mounted within the drill string. When drilling, a drilling fluid is pumped through the drill string and discharged from the drill bit to remove cuttings and debris. The mud motor, if present in the drill string, may be selectively powered using the circulating drilling fluid.

One common type of drill bit is a "fixed cutter" bit, wherein cutters (also referred to as cutter elements, cutting elements, or inserts) are secured to a bit body at fixed positions. The bit body may be formed from a high strength material, such as tungsten carbide, steel, or a composite/matrix material, and the cutters may include a substrate or support stud made of a carbide (e.g., tungsten carbide), and an ultra-hard cutting surface layer or "table" made of a polycrystalline diamond material or a polycrystalline boron nitride material deposited onto or otherwise bonded to the substrate. Such cutters are commonly referred to as polycrystalline diamond compact ("PDC") cutters.

Some cutters are strategically positioned along leading edges of blades defined on the bit body such that the cutters engage the formation during drilling. In use, high forces are exerted on the cutters, and over time, a working surface or cutting edge of each cutter eventually wears down or fails. The cutting edge of a fixed cutter may be continuously exposed to the formation, while an exposed surface of a rolling element may be successively exposed to the formation and withdrawn from the formation as it rotates on the drill bit. In some instances, rolling elements may provide depth of cut control to the fixed cutters.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

FIG. 3 illustrates a circle intersecting a top surface of one of the rolling elements at a particular radial coordinate as well as a plurality of fixed cutters at the radial coordinate.

DETAILED DESCRIPTION

The present disclosure relates to earth-penetrating drill bits and, more particularly, to rolling-type cutting or depth of cut control (DOCC) elements that can be used in drill bits. A rolling DOCC element may include a generally cylindrical body strategically positioned and secured to the drill bit so that the rolling element is able to engage the formation during drilling. In response to drill bit rotation, and depending on the selected orientation of the rolling element with respect to the body of the drill bit, the rolling element may roll against the underlying formation, cut against the formation, or may both roll against and cut the formation. Embodiments of the disclosure are directed methods for selecting the location and orientation of the rolling elements on the drill bits such that an outer surface of the rolling element maintains multiple zones of contact with the geologic formation to balance the forces acting the cylindrical body. Damage to the drill bit may thereby be prevented. In some embodiments, the methods include calculating a critical depth of cut for each point along a rolling element length of the rolling elements, changing at least one design variable, and recalculating the depth of cut until at least three contact points exist along the rolling element.

Figure 1:
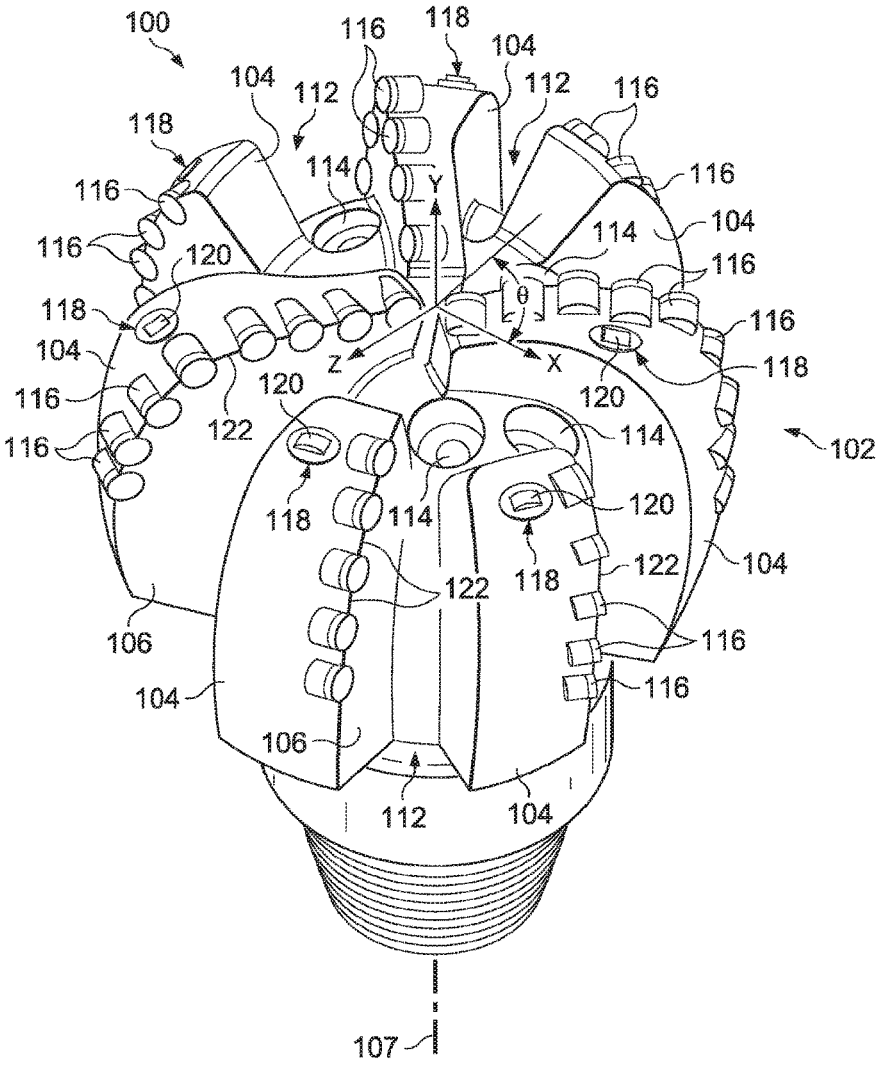
FIG. 1 is a perspective view of a rotary drill bit that illustrates both fixed cutters and rolling element assemblies secured on a bit body thereof.

FIG. 1 is a perspective view of an example drill bit 100 that illustrates both fixed cutters and rolling elements on a bit body 102. The drill bit 100 the present teachings may be applied to any fixed cutter drill bit category, including polycrystalline diamond compact (PDC) drill bits, drag bits, matrix drill bits, and/or steel body drill bits. While the drill bit 100 is depicted in FIG. 1 as a fixed cutter drill bit, the principles of the present disclosure are equally applicable to other types of drill bits operable to form a wellbore including, but not limited to, fixed cutter core bits, impregnated diamond bits and roller cone drill bits.

The bit body 102 of the drill bit includes radially and longitudinally extending blades 104 having leading faces 106. The bit body 102 may be made of steel or a matrix of a harder material, such as tungsten carbide. The bit body 102 rotates about a longitudinal drill bit axis 107 to drill into underlying subterranean formation under an applied weight-on-bit. Corresponding junk slots 112 are defined between circumferentially adjacent blades 104, and a plurality of nozzles or ports 114 can be arranged within the junk slots 112 for ejecting drilling fluid that cools the drill bit 100 and otherwise flushes away cuttings and debris generated while drilling.

The bit body 102 further includes a plurality of fixed cutters 116 secured within a corresponding plurality of cutter pockets sized and shaped to receive the cutters 116. Each cutter 116 in this example comprises a fixed cutter secured within its corresponding cutter pocket via brazing, threading, shrink-fitting, press-fitting, snap rings, or any combination thereof. The fixed cutters 116 are held in the blades 104 and respective cutter pockets at predetermined angular orientations and radial locations to present the fixed cutters 116 with a desired angle against the formation being penetrated. As the drill bit 100 is rotated, the fixed cutters 116 are driven through the rock by the combined forces of the weight-on-bit and the torque experienced at the drill bit 100. During drilling, the fixed cutters 116 may experience a variety of forces, such as drag forces, axial forces, reactive moment forces, or the like, due to the interaction with the underlying formation being drilled as the drill bit 100 rotates.

Each fixed cutter 116 may include a generally cylindrical substrate made of an extremely hard material, such as tungsten carbide, and a cutting face secured to the substrate. The cutting face may include one or more layers of an ultra-hard material, such as polycrystalline diamond, polycrystalline cubic boron nitride, impregnated diamond, etc., which generally forms a cutting edge and the working surface for each fixed cutter 116. The working surface is typically flat or planar, but may also exhibit a curved exposed surface that meets the side surface at a cutting edge.

Generally, each fixed cutter 116 may be manufactured using tungsten carbide as the substrate. While a cylindrical tungsten carbide "blank" can be used as the substrate, which is sufficiently long to act as a mounting stud for the cutting face, the substrate may equally comprise an intermediate layer bonded at another interface to another metallic mounting stud. To form the cutting face, the substrate may be placed adjacent a layer of ultra-hard material particles, such as diamond or cubic boron nitride particles, and the combination is subjected to high temperature at a pressure where the ultra-hard material particles are thermodynamically stable. This results in recrystallization and formation of a polycrystalline ultra-hard material layer, such as a polycrystalline diamond or polycrystalline cubic boron nitride layer, directly onto the upper surface of the substrate. When using polycrystalline diamond as the ultra-hard material, the fixed cutter 116 may be referred to as a polycrystalline diamond compact cutter or a "PDC cutter," and drill bits made using such PDC fixed cutters 116 are generally known as PDC bits.

As illustrated, the drill bit 100 may further include a plurality of rolling element assemblies 118, each including a rolling element 120. The rolling element 120 may include a generally cylindrical body strategically positioned in a predetermined position and orientation on the bit body 102 so that the rolling element 120 is able to engage the formation during drilling. The orientation of a rotational axis $A_0$ (FIG. 2A) of each rolling element 120 with respect to a tangent to an outer surface of the blade 104 may dictate whether the particular rolling element 120 operates purely as a rolling DOCC element, purely a rolling cutting element, or a hybrid of both. The terms "rolling element" and "rolling DOCC element" are used herein to describe a rolling element 120 in any orientation, whether it acts purely as a DOCC element, a purely as cutting element or as a hybrid of both. Rolling elements 120 may prove advantageous in allowing for additional weight-on-bit (WOB) to enhance directional drilling applications without over engagement of the fixed cutters 116. Effective DOCC also limits fluctuations in torque and minimizes stick-slip, which can cause damage to the fixed cutters 116. An optimized three-dimensional position and three-dimensional orientation of the rolling element 120 may be selected to extend the life of the rolling element assemblies, and thereby improve the efficiency of the drill bit 100 over its operational life. As described herein, the three-dimensional position and orientation may be expressed in terms of a Cartesian coordinate system with the Y-axis positioned along the longitudinal axis 107, and a polar coordinate system with a polar axis along the X-axis of Cartesian coordinate system.

Figure 2A:
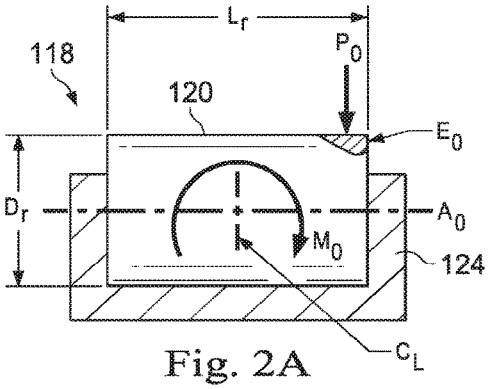
FIG. 2A is a schematic side view of a rolling element assembly having a rolling element that defines a generally cylindrical body, wherein the cylindrical body is in a generally unbalanced operational loading.

FIG. 2A is a schematic side view of a rolling element assembly 118 having a rolling element 120 experiencing a generally unbalanced operational loading. As illustrated, the rolling element 120 defines a generally cylindrical body arranged to rotate about the rotational axis $A_0$ within a frame 124. In other embodiments, a rolling element (not shown) having an alternate profile, e.g., a convex, concave or irregular profile, may be provided to rotate within the frame 124 without departing from aspects of the disclosure. The frame 124 supports the rolling element 120 therein such that an entire rolling element length Lr of the rolling element 120 protrudes from the frame 124. In operation, the rolling element 120 may thus contact a geologic formation along the entire rolling element length Lr thereof. A portion of a rolling element diameter Dr of the rolling element is disposed generally within the frame 124 such that the frame 124 retains the rolling element 120 therein.

In operation, the rolling element 120 may contact the geologic formation over a single contact area $E_0$ along the rolling element length Lr. The rolling element 120 may thereby experience a resultant operational load $P_0$ at a top surface 128 of the rolling element 120. Where the resultant force $P_0$ is laterally offset from a centerline $C_L$ of the rolling element, the force $P_0$ generates a moment $M_0$. The moment $M_0$ may deform or damage the frame 124, and potentially lead to the loss of the rolling element 120 from the frame 124.

Figure 2B:
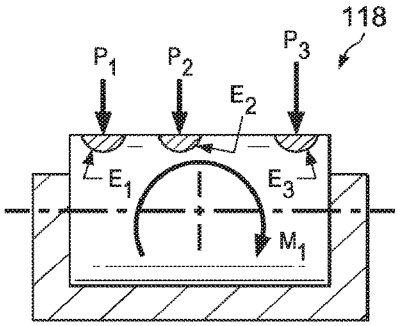
FIG. 2B is a schematic view side of the rolling element assembly of FIG. 2A illustrating a generally balanced loading of the cylindrical body.

FIG. 2B is a schematic side view of the rolling element assembly 118 with the rolling element 120 experiencing a generally balanced operational loading. As illustrated in FIG. 2B, where the rolling element 120 is arranged to contact the formation over at least three contact areas $E_1$, $E_2$, $E_3$, along the rolling element length Lr, the moment induced by an applied force $P_3$ may be at least partially balanced by forces $P_1$ and $P_2$ applied on an opposite side of the centerline $C_L$. In this manner, the resultant moment $M_1$ may be reduced, wear on an outer rolling surface of the rolling element 120 may be relatively even across the rolling element length Lr, and durability of the rolling element assembly 118 will be improved. In ideal conditions, the entire rolling element length Lr of the rolling element 120 is maintained in contact with the formation for a critical depth of cut, and the moment $M_1$ acting on the rolling element assembly 118 is very close to zero.

Figure 3:
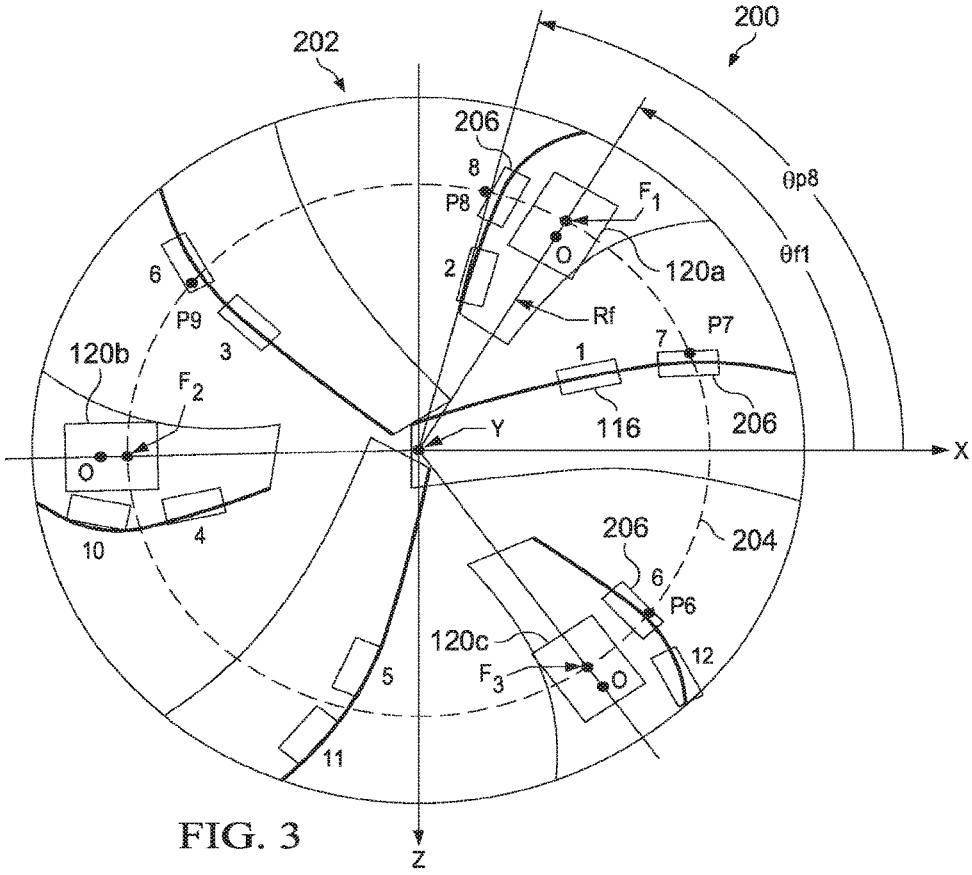
FIG. 3 is a schematic top view of a drill bit illustrating the locations of fixed cutters and three rolling elements on a bit face of the drill bit, which may be arranged to provide an improved operational life of the rolling elements and depth of cut control for the drill bit.

FIG. 3 is a schematic top view of an example drill bit 200 illustrating design locations of fixed cutters 116 and rolling element assemblies 118 on a bit face 202 of the drill bit 200. The bit face 202 may be defined at the leading end of a bit body 102 (FIG. 1), and in the example embodiment illustrated includes twelve fixed cutters 116 numbered 1 through 12 and three rolling elements 120*a*, 120*b* and 120*c* (collectively or generally 120) having control points thereon respectively numbered F1 through F3. The drill bit 200 represents one example arrangement of the cutters 116 and rolling elements 120 that may be considered in determining an optimized position and orientation of the rolling elements 120 in accordance with principles of the disclosure. Aspects of the disclosure may be practiced with more or fewer cutters 116 and or rolling elements 120 arranged in various other configurations.

Once the locations of the fixed cutters 116 are determined, and an initial location and orientation of the rolling elements 120 is selected, the design variables associated with the position and orientation of the rolling elements 120 may be defined. As illustrated in FIG. 3, an angular position θ of a component on the bit face 202 may generally be defined between the X-axis and the plane extending through the Y-axis and the component. For example, an angular position of the control point F1 on the rolling element 120*a* is generally represented by the coordinate $\theta_{f1}$. A radial spacing from the Y-axis may be generally represented by a radius "R." For example, the radial offset of the control point F1 (and the rolling center "O") of the rolling element 120*a* may be represented by the radius Rf.

A circle 204 having the radius Rf intersects cutting edges 206 at the leading faces of the fixed cutters 116 numbered 6, 7, 8 and 9 at intersection points P6, P7, P8 and P9 respectively. The intersection points P6, P7, P8 and P9 may have the same rotational path as control points F1, F2 and F3 and, thus, may have a depth of cut that may be affected by the control points of the rolling elements 120. The angular position of a point "P" intersecting the circle 204 is generally represented by the coordinate $\theta_p$. For example, $\theta_{p8}$ represents the angle defined between the X-axis and the line extending from the Y-axis to the intersection point "P8." Since the radial positions of the rolling elements 120*a*, 120*b* and 120*c* are not necessarily the same, the rolling centers "O" of the rolling elements 120*a*, 120*b* and 120*c* may not all fall on the same circle.

Figure 4:
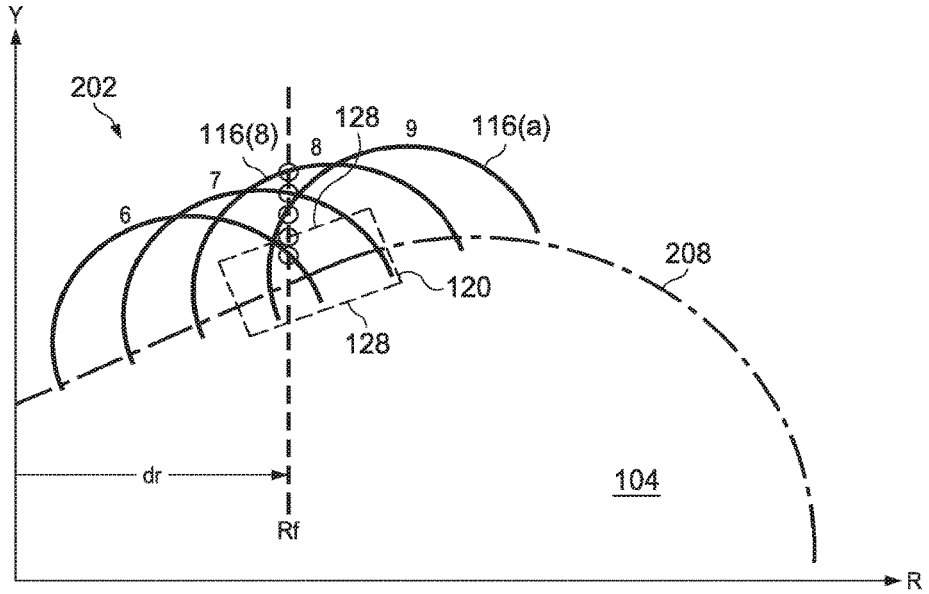
FIG. 4 is a schematic profile view of the bit face of FIG. 3 illustrating the axial and radial positions of the rolling element and the fixed cutters that intersect the circle.
Figure 4A:
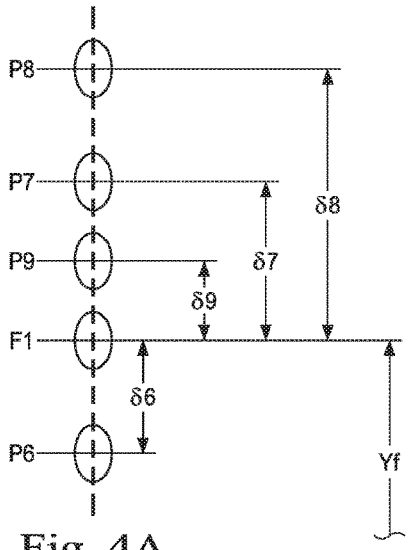
FIG. 4A is a schematic graphical view of the relative axial positions of the top surface of the rolling element of FIG. 4 at the radial coordinate and the intersection points defined where the fixed cutters intersect the circle, illustrating an axial underexposure of each of the fixed cutters at the radial coordinate.

FIG. 4 is a schematic view of the bit face 202 of FIG. 3 illustrating the axial and radial positions of a rolling element 120*a* having a control point F1 arranged to control the depth of cut of fixed cutters 116 (6, 7, 8 and 9). The rolling element 120*a* and the fixed cutter 116 (8) are both secured on the same blade 104 (FIG. 1) having a profile 208 in the Y-R plane, while the rolling element 120*a* and fixed cutters (6, 7 and 9) are secured on different blades 104. An axial underexposure δ (FIG. 4A) generally defines an axial distance that the control point F1 on the rolling element 120*a* is disposed below each of the fixed cutters 116 on the profile 208. For a particular radial coordinate dr, e.g., Rf, an axial underexposure δ is defined as the axial distance between an axial coordinate Yf of top surface 128 of the rolling element 120 and the axial coordinate of each of the intersection points "P." For example, δ8 represents the axial distance between the top surface 128 of the rolling element 120 (F1) at the radial coordinate Rf and the top of the fixed cutter 116 (8) at the radial coordinate Rf, e.g., at point P8. The axial underexposure δ6 is illustrated as being generally negative since the intersection point P6 is disposed axially below the top surface 128 at the radial coordinate Rf.

Figure 4B:
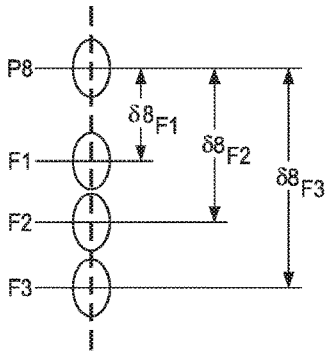
FIG. 4B is a schematic graphical view of the relative axial positions of one of the intersection points of FIG. 4A and the top surface of each of the rolling elements of FIG. 4.

As illustrated in FIG. 4B, an axial underexposure δ (measured along Y axis) is defined between each intersection point "P" and each of the rolling elements 120. Since each of the rolling elements 120 (F1, F2, F3) may be disposed at different axial coordinates Yf ($Yf_{F1}$, $Yf_{F2}$, $Yf_{F3}$), an axial underexposure δ8 (e.g., $\delta 8_{F1}$, $\delta 8_{F2}$, $\delta 8_{F3}$) may be defined with respect to each of the rolling elements 120 (F1, F2, F3).

Figure 5:
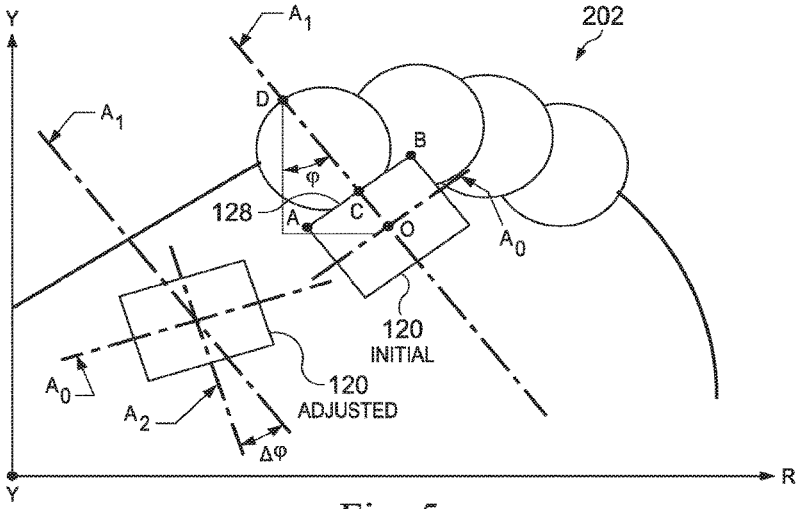
FIG. 5 is a schematic profile view of the bit face of FIG. 3 illustrating the orientation, axial position and radial position of the fixed cutters and rolling elements.

FIG. 5 is a schematic profile view of the bit face of FIG. 3 generally illustrating orientations of a rolling element 120 in a Y-R plane defined by axial (Y) and radial (R) axes. The rolling element 120 defines a rolling center "O" as described above, and at least three control points A, B and C along the top surface 128. The control points A and B are generally located at ends of the top surface 128 and define a radial interval of the rolling element 120 on the bit face 202. The control point C is located between the control points A and B. The control points A, B, C generally represent locations along the top surface 128 that may be evaluated for contact with the formation during drilling operations. More or fewer control points may be evaluated, and in some embodiments, tens or hundreds of control points may be evaluated in practice.

An axis A, extends normally to the rolling axis $A_0$ in the Y-R plane and extends through control point C and the rolling center O. A profile angle φ is defined between the axis $A_1$ and the vertical or Y-axis. In the optimization and/or selection processes described below, a rolling element 120 may or may not ever initially be disposed at the profile angle φ, but the profile angle φ provides a basis for an adjusted profile angle Δφ, which defines an orientation of the rolling element 120 in the Y-R plane. The adjusted profile angle Δφ is defined between the axis $A_1$ of the rolling element 120 in the "initial" orientation and the axis $A_2$ of the rolling element 120 in the adjusted orientation.

Figure 6:
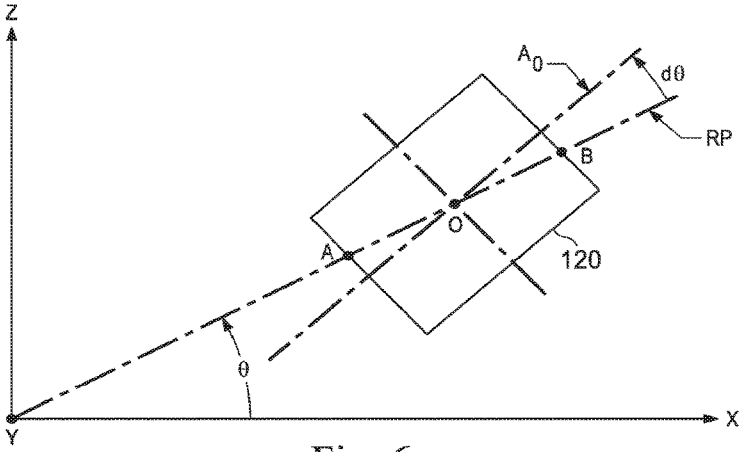
FIG. 6 is a schematic top view of one of the rolling elements of FIG. 3 illustrating a rotational orientation of the rolling element.

FIG. 6 is a schematic profile view of the bit face of FIG. 3 generally illustrating an orientation of the rolling element 120 in a Z-X plane defined by the horizontal axes Z and X. An angular position of θ of the rolling element 120 may be defined between the X axis and a radial plane RP passing through the Y-axis and the rolling center "O" of the rolling element 120. An adjusted angular position dθ of the rolling element 120 is defined as the angle subtended between the radial plane RP and rolling axis $A_0$ of the rolling element 120. The adjusted angular position dθ of the rolling element 120 thereby defines the orientation of the rolling element 120 in the Z-X plane.

The control points A and B are defined along the radial plane RP. The rolling element 120 may control a depth of cut within the radial interval defined between the control points A and B.

Figure 7A:
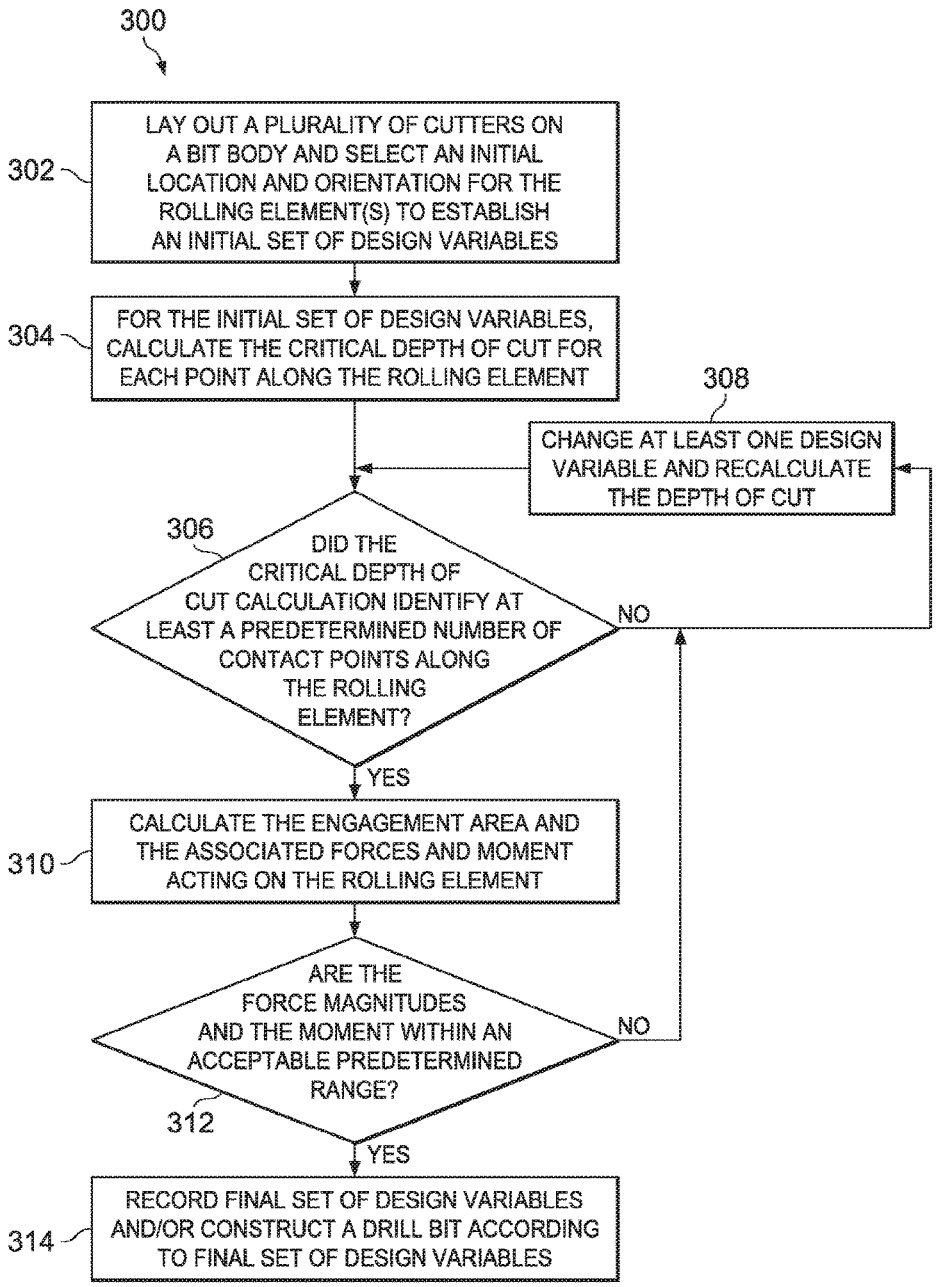
FIG. 7A is flowchart illustrating a procedure for selecting the location and orientation of the rolling elements on a drill bit face to balance operational forces on the rolling elements.

FIG. 7A is flowchart illustrating a procedure for selecting the location and orientation of the rolling elements 120 on a drill bit face to balance operational forces on the rolling elements 120. The steps of method 300 may be performed by various computer programs, models or any combination thereof, configured to simulate and design drilling systems, apparatuses and devices. The programs and models may include instructions stored on a computer readable medium and operable to perform, when executed, one or more of the steps described below. The computer readable media may include any system, apparatus or device configured to store and retrieve programs or instructions such as a hard disk drive, a compact disc, flash memory or any other suitable device. The programs and models may be configured to direct a processor or other suitable unit to retrieve and execute the instructions from the computer readable media. Collectively, the computer programs and models used to simulate and design drilling systems may be referred to as a "drilling engineering tool" or "engineering tool."

Initially at step 302, a plurality of fixed cutters 116 and rolling element assemblies 118 may be laid out on a bit body to achieve a desired set of design objectives. The initial position and orientation of the rolling element assemblies 118 may be selected such that the rolling elements 120 provide particular depth of cut control characteristics and cutting characteristics. Once the initial position and orientation of the rolling elements 120 are selected, an initial set of design variables is established. Each rolling element 120 will be defined by at least the following variables:

1) δ=under exposure, i.e., the distance from top of a fixed cutter 116
2) φ=profile angle
3) Δφ=adjusted profile angle
4) θ=angular position from an X-axis
5) dθ=adjusted angular position
6) dr=radial offset from a Y-axis (e.g., a bit rotational axis)
7) Dr=rolling element diameter
8) Lr=rolling element length Generally, the rolling element diameter Dr and the rolling element length Lr of a cylindrical rolling element defines the shape of the rolling element 120, the radial offset dr, angular position θ and the under exposure δ define a position of the rolling element 120, and the profile angle φ, adjusted profile angle Δφ and adjusted angular position dθ define an orientation of the rolling element 120 on the bit body 102. Once an initial set of design variables is determined for each of the rolling element 120, the procedure may proceed to step 304.

At step 304, using the set of design variables, a critical depth of cut is determined for each control point, e.g., A, B. C (FIG. 5), along the top surface 128 rolling element 120. The critical depth of cut may be expressed in the units of inches per revolution, and generally indicates the degree to which each point along the rolling element length Lr of the rolling element 120 will penetrate the geologic formation in operation. The critical depth of cut calculation may be used to assess how even the depth of cut is across the rolling element length Lr. Any number of control points may be selected, and in some embodiments, at least three control points are selected. In some embodiments, an engineering tool may calculate a critical depth of cut at hundreds of control points evenly spaced along the top surface 128 of the rolling element 120. Specific steps for calculating the critical depth of cut are described herein with respect to FIG. 7B below.

At decision 306, it is determined whether the critical depth of cut calculation revealed at least a predetermined number of contact zones where the rolling element is in contact with the geologic formation. The contact zones represent the radial distance dr where the rolling element 120 is controlling the depth of cut achieved by the fixed cutters 116 at the same radial distance dr. In some embodiments, the predetermined number of contact zones is two distinct contact zones located on opposite lateral sides of the rolling center O. This arrangement permits the forces acting on the rolling element 120 to balance one another to some extent. In some embodiments, the predetermined number of contact zones is at least three contact zones. If the number of contact zones identified along the rolling element length Lr of the rolling element from 120 is fewer than the predetermined number of contact zones, then the procedure may proceed to step 308.

At step 308, at least one design variable may be changed to establish an adjusted set of design variables. For example, the under exposure δ may be increased or decreased. The adjusted profile angle Δφ and/or the adjusted angular position dθ of rolling element may be changed to rotate the rolling element 120 to an orientation expected to increase contact between the rolling element and the geologic formation. In some embodiments, the shape and/or position of the rolling element 120 may also be changed to increase contact with the geologic formation. In some embodiments, the engineering tool may be configured to systematically change the at least one design variable and in other embodiments, a bit designer may input the change to the at least one design variable into the engineering tool.

Once the at least one design variable has been changed, the critical depth of cut Δ for each control point along the rolling element length of the rolling element 120 may be recalculated using the adjusted set of design variables. The procedure 300 may then return to decision 306 where it is again determined whether the predetermined number of contact zones exists for a given critical depth of cut. The decision 306 and step 308 may be repeated iteratively until the predetermined number of contact zones is found to exist for a given critical depth of cut. Then, the procedure 300 may progress to step 310.

At step 310, an engagement area Af is calculated along with the resultant operational loads P acting on the rolling element 120. The engagement area Af represents the cross sectional area of the rolling element 120 that penetrates into the geologic formation in operation (see FIG. 8B). The resultant operational loads P may each include a tangential component $P_{tan}$ and a radial component $P_{rad}$ with respect to the rolling element 120 (see FIGS. 8A and 8B). From the magnitude and position of the radial component $P_{rad}$ of the operational loads P, the moment M acting on the rolling element 120 may be calculated. Specific steps for calculating the engagement area Af, resultant operational loads P, and moment M are specified in the procedure of FIG. 7C.

At decision 312, the engineering tool may determine whether the operational loads P and the moment M are within an acceptable predetermined range. If the rolling element 120 does not meet all design requirements, at least one of the operational loads P and the moment M may fall outside the acceptable predetermined range. The procedure 300 may then return to step 308 where at least one design variable is changed. Steps and decisions 308, 306, 310 and 312 may be repeated and iterated, at least until the operational loads P and the moment M fall within the acceptable predetermined range. The procedure 300 may then progress to step 314.

At step 314, the adjusted set of design variables that yielded the operational loads P and the moment M falling within the predetermined range may be recorded as a final set of design variables. In some embodiments, a drill bit may be constructed with rolling element(s) 120 located and oriented according to the final set of design variables.

Figure 7B:
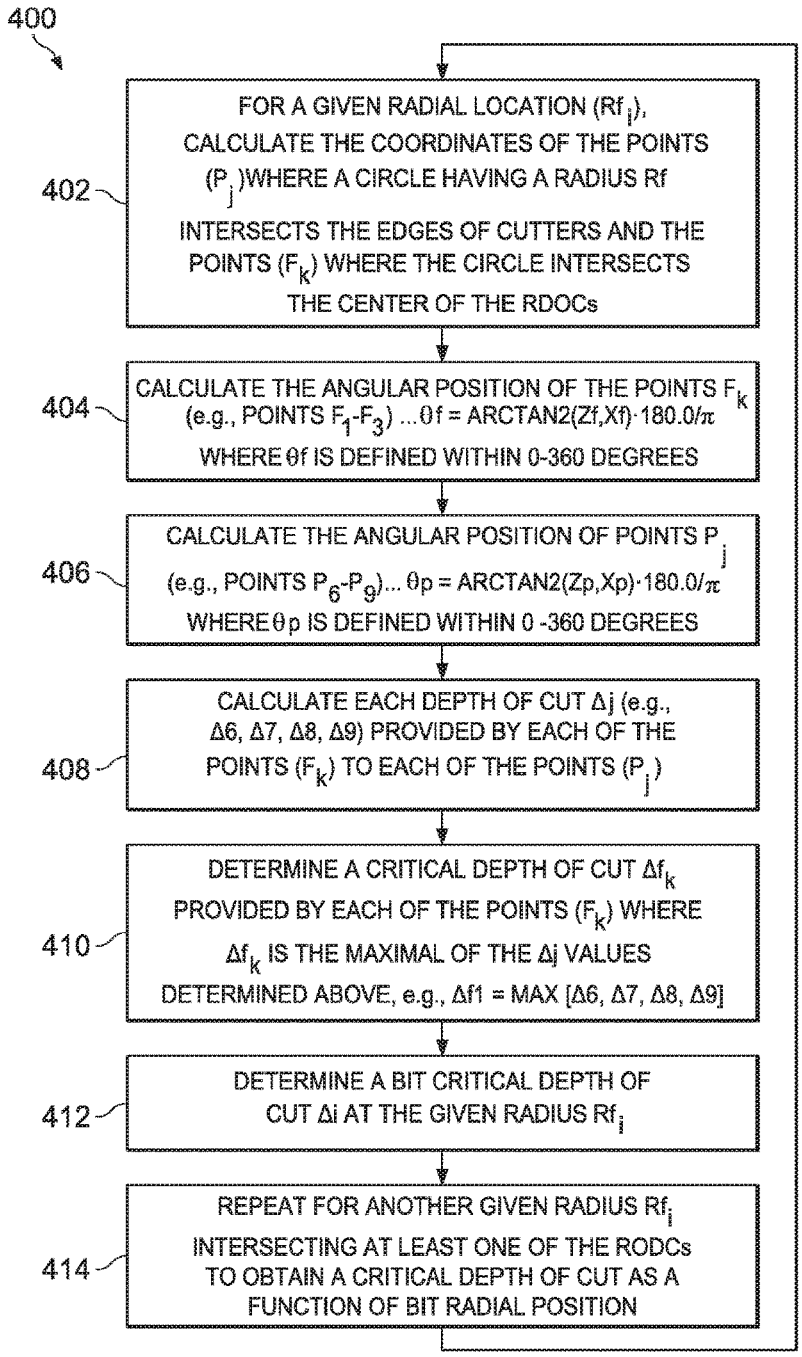
FIG. 7B is a flowchart illustrating a procedure for calculating a critical depth of cut as specified in the procedure of FIG. 7A.

FIG. 7B is a flowchart illustrating a procedure 400 for calculating a critical depth of cut Δ specified in steps 304 and 308 the procedure 300 of FIG. 7A. The procedure 400 permits a critical depth of cut Δ to be calculated for each radial position Rf on the drill bit that includes an RODCC. Since the procedure 400 may be performed after step 302 (FIG. 7A) of procedure 300 where the initial set of design variables is established, the coordinates Xf, Yf, and Zf of the points F located on a radial plane passing through the bit axis 107 (y-axis) and the center of a rolling element 120 may have been established prior to step 402 of the procedure 400.

At step 402, at a given radial location $Rf_i$, the coordinates of the points $P_j$ where the circle 204 (FIG. 3) having a radius $Rf_i$ intersects the edges of cutters 116 and the points $F_k$ where the circle intersects the center of the rolling elements 120. Here, the index "i" represents the specific control point, e.g., A to C, along the radial plane RP passing through one of the rolling elements 120 (see FIG. 6), the index "j" represents the number of the fixed cutter 116 intersecting the circle 204, e.g., 6, 7, 8, and 9, and the index "k" represents the number of the rolling element 120, e.g., 1, 2 and 3. Once the Cartesian coordinates of the points $P_j$, $F_k$ for a given radial location are compiled, the procedure 400 may proceed to step 404.

At step 404, the angular positions $\theta f_k$ of the points $F_k$ (e.g., points $F_1$-$F_3$) are calculated. Where the angular position $\theta f_k$ is defined within 0°-360°, the angular position $\theta f_k$ may be given by the equation:

$$\theta f_k = \arctan 2(Zf_k, Xf_k) \cdot 180.0/\pi.$$

At step 406, the angular positions $\theta p_j$ of the points $P_j$ (e.g., points $P_6$-$P_9$) are similarly calculated. Where the angular position $\theta p_j$ is defined within 0°-360°, the angular position $\theta p_j$ may be given by the equation:

$$\theta p_j = \arctan 2(Zp_j, Xp_j) \cdot 180.0/\pi.$$

At step 408 the critical depth of cut Δj provided to each point $P_j$ by each $F_k$ may be calculated. The critical depth of cut Δj may be given by the equation:

$$\Delta j = \delta j \cdot 360/(360 - \Delta\theta j).$$

To calculate the critical depth of cut Δj using the equation above, an angular offset $\Delta\theta_j$ between the points $P_j$ and the points $F_k$ must be determined as well as the axial underexposure δj of the points $P_j$ with respect to the points $F_k$. The angular offset $\Delta\theta_j$ (defined within 0°-360°), and the axial underexposure δj may be given by the equations below.

$$\Delta\theta_j = \theta f_k - \theta p_j$$

$$\delta j = Yp_j - Yf_k$$

At step 410, once the critical depths of cut Δj are calculated, the critical depths of cut provided by each of the points $F_k$ may be calculated as the maximal of the critical depths of cut Δj by the equation given below.

$$\Delta f_k = \max [\Delta j].$$

For example, the critical depth of cut provided by the point F1 is the maximal of Δ6, Δ7, Δ8, and Δ9 for the bit face 202 illustrated in FIG. 3. Once the critical depths of cut provided by each of the points $F_k$ are calculated, the procedure 400 may progress to step 412.

At step 412, a bit critical depth of cut Δi at the given radius $Rf_i$ is determined. The bit critical depth of cut at the radius Rf, is given by the equation below.

$$\Delta i = \min [\Delta f_k].$$

Once the bit critical depth of cut Δi at the given radius $Rf_i$ is determined, the procedure may progress to step 414 where the index "i" is updated, and the steps of the procedure 400 are repeated for another different radius $Rf_i$. The index "i" may range from zero (0) to the radius of the bit face 202 such that the critical depth of cut Δi may be plotted as a function of radial position of the bit face (see, e.g., FIG. 10).

Figure 7C:
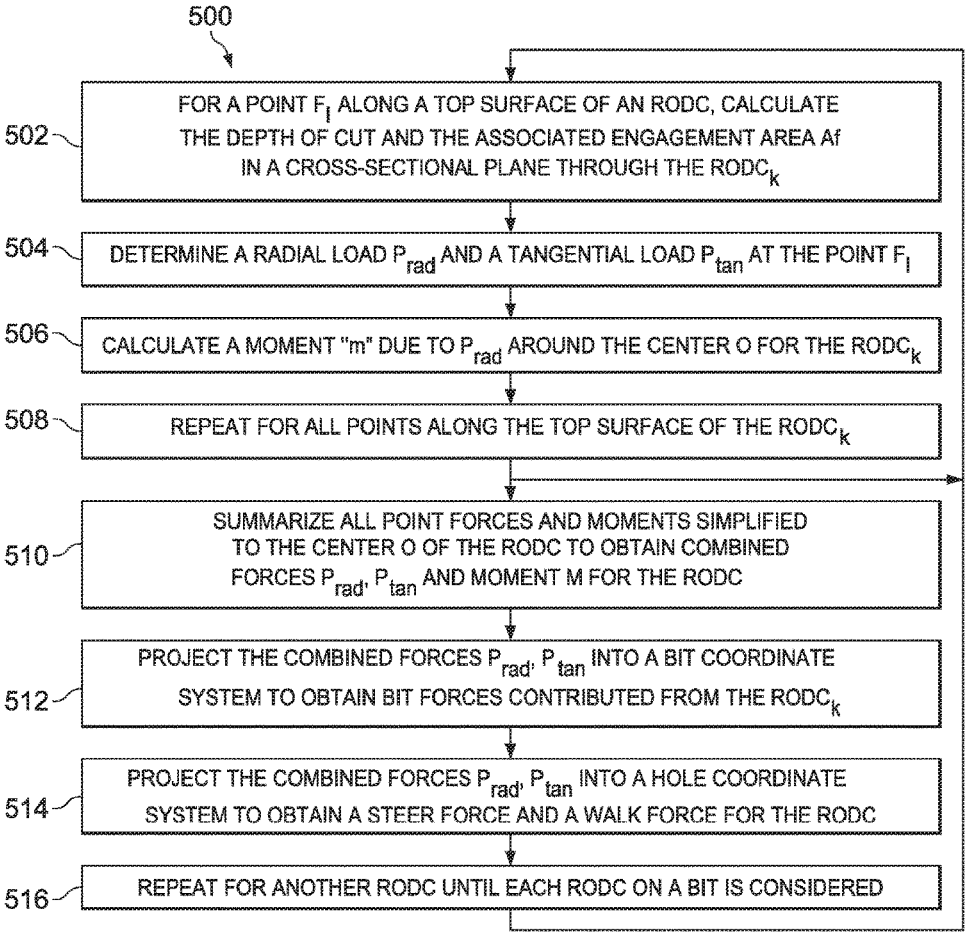
FIG. 7C is a flow chart illustrating a procedure for calculating the forces and moment acting on a rolling element as specified in the procedure of FIG. 7A.
Figure 8A:
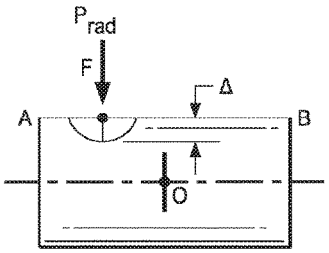
FIGS. 8A and 8B are side and end views, respectively, of a rolling element of FIG. 3 illustrating the operational loads acting on the rolling element as specified in the procedure of FIG. 7C.
Figure 8B:
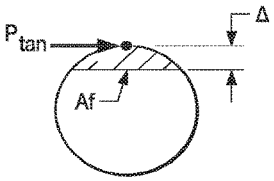

FIG. 7C is a flow chart illustrating a procedure 500 for calculating the operational loads P and moment "m" acting on a rolling element 120 as specified in step 310 of the procedure 300 of FIG. 7A. FIGS. 8A and 8B are side and end views, respectively, of the rolling element 120 illustrating the operational loads acting on the rolling element as 120 specified in the procedure 500 of FIG. 7C.

At step 502, the depth of cut $\Delta F_l$ for any point $F_l$ on the top surface 128 of the rolling element 120 is determined in cross sectional plane (see FIG. 8A). The depth of cut Δ may be determined or based on the results of step 412 of the procedure 400 described above where the bit critical depth of cut Δi at the given radius $Rf_i$ has been determined. At step 504, the associated engagement area Af defined between the rolling element 120 and the geologic formation determined from the depth of cut $\Delta F_l$ and the particular geometry of the rolling element 120.

At step 504, a force model may be applied to determine the radial component $p_{rad}$ of the point operational loads p applied at the particular point $F_l$ of the rolling element 120. The force model may define the radial component $p_{rad}$ as a function of the depth of cut $\Delta F_l$ and the engagement area Af determined above, as well as other known, ascertainable or estimable variables such as the rock strength. The tangential component $p_{tan}$ of the operational loads $P_{tan}$ at the particular point $F_l$ may then be determined from the radial component $p_{rad}$ and a rolling coefficient of friction μ the by the following equation.

$$p_{tan} = \mu p_{rad}.$$

At step 506, a moment "m" about the rolling center "O" due to the radial component $p_{rad}$ at the particular point $F_l$ may be determined. At step 508, the index l may be updated, and the operational loads $p_{rad}$, $p_{tan}$ and "m" may be determined for another point $F_l$ on the top surface 128 of the rolling element 120. Steps 502 through 508 may be repeated and iterated until all the points along the top surface 128 of the rolling element 120 are considered.

The procedure 500 may then proceed to step 510. All the point loads $p_{rad}$, $p_{tan}$ and moments "m" may be summarized and simplified to the center "O' to obtain combined loads $P_{rad}$, $P_{tan}$ and moment M for the rolling element 120. At step 512 the combined forces $P_{rad}$, $P_{tan}$ may be projected into a bit coordinate system to obtain bit forces contributed from the rolling element 120. At step 514 the combined forces $P_{rad}$, $P_{tan}$ may be projected into a hole or wellbore coordinate system to obtain steer force and a walk force for the rolling element 120. At step 516, the index k may be updated, and each of the rolling elements 120 on the bit face 202 may be considered.

Figure 9A:
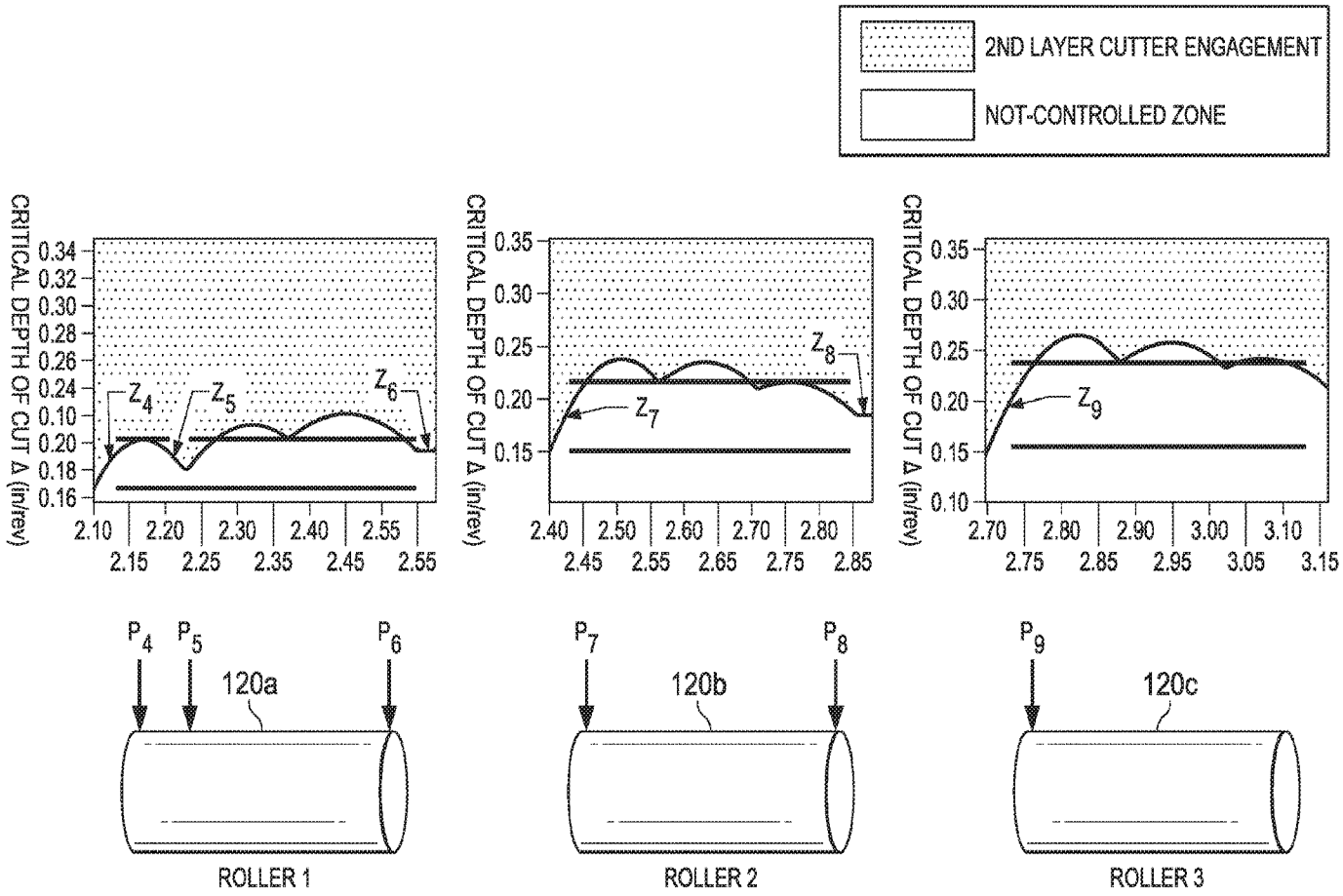
FIG. 9A is a schematic view of the three rolling elements of FIG. 3 illustrating an example operational loading prior to performing the procedure of FIG. 7A wherein operational loads are balanced on a first of the three rolling elements and unbalanced on second and third rolling elements.

FIG. 9A is a schematic view of the three rolling elements 120 of FIG. 3 illustrating an example operational loading prior to performing any optimization in the procedure 300 of FIG. 7A. Generally, the operational loads P are balanced on a first rolling element 120*a* of the three rolling elements 120 and unbalanced on second 120*b* and third 120*c* of the rolling elements 120. The operational loads P illustrated in FIG. 9A were determined based on a bit rotation rate of 120 RPM and rate of penetration (ROP) of 120 ft/hr. The location and orientation of the rolling elements 120 were selected based an initial layout of the bit face 202 (see step 302 of procedure 300 on FIG. 7A) before any optimization or change to any of the design variables defining the rolling elements 120 was implemented.

The operational loads $P_4$ through $P_9$ on the rolling elements 120*a*, 120*b* and 120C represent the combined radial components $p_{rad}$ of the point loads spanning a specific contact zone $Z_4$ through $Z_9$ existing along the rolling element length of the rolling elements 120. The contact zones $Z_4$ through $Z_9$ may be identified from a plot of the critical depth of cut control curves for each of the rolling elements 120 plotted against the bit radius.

For example, three distinct contact zones $Z_4$, $Z_5$ and $Z_6$ were identified along the first rolling element 120*a* where the critical depth of cut curve for the first rolling element 120*a* indicated a critical depth of cut control beneath a threshold "T." The threshold "T" may represent a desired minimum depth of cut to be maintained in operation for the radial interval on the bit face 202 containing the rolling element 120*a*. The upper shaded region of the critical depth of curves illustrated in FIG. 9A represent the critical depths of cut Δ where the rolling elements 120 will be in engagement with the geologic formation, and the lower un-shaded region critical depth of cut curves represent an un-controlled region. Thus, the portions of the shaded regions extending below the threshold "T" represent the zones of contact between the upper surfaces 128 of the rolling elements 120 and the geologic formation when the minimum depth of cut is maintained in operation. In some embodiments, the threshold "T" may be predetermined by a bit designer. For example, if a bit designer desired that the rolling element would be in contact with the formation only if ROP was over 120 ft/hr with an RPM equal to 120, the threshold "T" could be 0.2 in/rev.

Since three distinct contact zones $Z_4$, $Z_5$ and $Z_6$ were identified along the first rolling element 120*a*, this rolling element 120*a* may be found to provide the predetermined number of contact points described in above with reference to decision 306 of the procedure 300 (see FIG. 7A). Since only two distinct contact zones $Z_7$, $Z_8$ were identified along the second rolling element 120*b*, operational loads $P_7$ and $P_8$ may only partially balance one another on the second rolling element 120*b*. For example, where the magnitude of the operational loads $P_7$ and $P_8$ are substantially different, the loads $P_7$ and $P_8$ may produce a moment on the second rolling element 120*b*. Since only one distinct contact zone $Z_9$ was identified along the third rolling element 120*c*, no operational load is available to balance the operational load P9 on the third rolling element 120*c*. Thus, if no optimization is performed, the third rolling element 120*c* may be estimated to be the first to fail in operation.

Figure 9B:
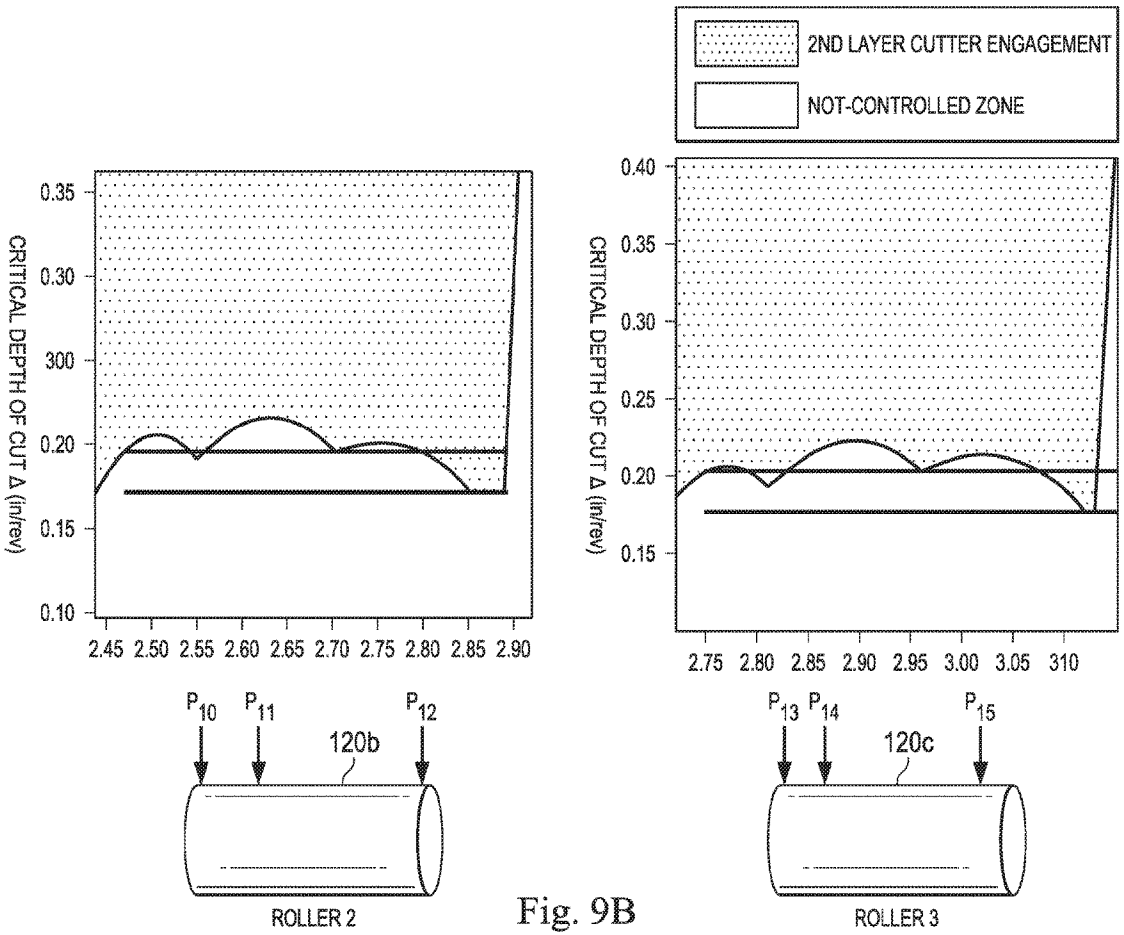
FIG. 9B is a schematic view of the second and third rolling elements of FIG. 9A illustrating an example operational loading subsequent to performing the procedure of 7A wherein the operational loads are balanced on the second and third rolling elements.

FIG. 9B is a schematic view of the second and third rolling elements 120*b*, 120*c* of FIG. 9A illustrating an example operational loading subsequent to performing an optimization in the procedure of 7A. By changing at least one design variable as specified in step 308 of the procedure 300 (FIG. 7A) to redesign, reposition and/or reorient the second and third rolling elements on the bit face 202 (FIG. 3), at least three contact zones $Z_{10}$, $Z_{11}$ and $Z_{12}$ may be identified on the second rolling element 120*b*, and at least three contact zones $Z_{13}$, $Z_{14}$ and $Z_{15}$ may be identified on the third rolling element 120*c*. The operational loads $P_{10}$ and P11 may be balanced by operational load $P_{12}$ on the second rolling element 120*b* and operational loads $P_{13}$ and $P_{14}$ may be balanced by operational load $P_{15}$ on the third rolling element. By balancing the operational loads on the all three rolling elements, the operational life of the rolling elements 120, and thus the drill bit 200 (FIG. 3) on which the rolling elements 120 are placed, may be extended.

Figure 10:
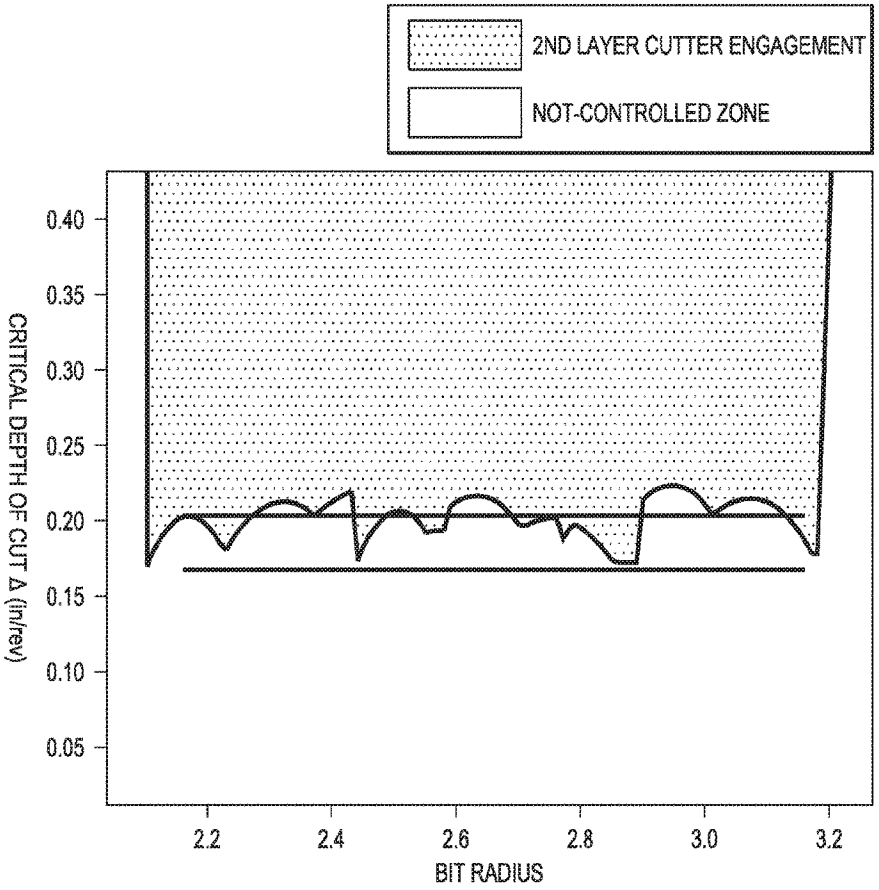
FIG. 10 is a diagrammatic view of the critical depth of cut calculated in the procedure of FIG. 7A for all three of the rolling elements of FIG. 3, wherein the critical depth of cut is charted against a bit radius for a radial portion of the drill bit.

FIG. 10 is a diagrammatic view of the optimized critical depth of cut curves calculated in the procedure of FIG. 7A for all three of the rolling elements 120 of FIG. 3. Where the critical depth of cut is charted against a bit radius for the radial portion of the drill bit including the rolling elements 120, the controlled depth of cut provided by the rolling elements be evaluated.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, the disclosure is directed to a method of configuring a rolling depth of cut controller (RDOCC) of a drill bit. The method includes (a) selecting a position and an orientation for a first rolling element of the RDOCC on a bit face of a drill bit, the first rolling element defining a top surface along a generally cylindrical body thereof, (b) establishing a set of design variables associated with the position, the orientation and a shape of the first rolling element, (c) calculating a critical depth of cut for a plurality of control points along the top surface of the first rolling element using the design variables, (d) identifying a number of contact zones existing along the top surface of the rolling element from the critical depth of cut calculated, (e) determining an engagement area and associated force magnitudes of operational forces acting on the rolling element for each of the contact zones identified, (f) ascertaining a moment acting on the rolling element from the force magnitudes determined, and (g) comparing the force magnitudes and the moment to predetermined limits.

In one or more example embodiments, identifying the number of contact zones existing along the rolling element length of the rolling element includes identifying at least two distinct contact zones on opposite lateral sides of a rolling center of the first rolling element. Identifying the number of contact zones may include identifying at least three distinct contact zones.

In some embodiments, the method further includes identifying a number of contact zones existing along the top surface of the first rolling element that includes less than three distinct contact zones, changing at least one of the design variables to establish an adjusted set of design variables, and recalculating the critical depth of cut for the plurality of control points along the top surface of the first rolling element using the adjusted set of design variables. Changing at least one of the design variables may include changing at least one of an adjusted profile angle and an adjusted angular position of the first rolling element defining an orientation of the first rolling element on the drill bit.

In example embodiments, the method further includes deciding that at least one of the force magnitudes and the moment are outside the predetermined limits, and changing at least one of the design variables to establish an adjusted set of design variables. The method may also further include determining a plurality of intersection points associated with cutting edges of fixed cutters on the bit face, each of the plurality of intersection points having substantially the same radial location as one of the control points, and calculating a critical depth of cut provided by each of the control points to each of the intersection points based on differences in position defined between the control points and the intersection points. The method may further include determining a critical depth of cut for each of the control points as a maximal of the depths of cut provided to each of the intersection points by each of the control points. In some embodiments, the method also includes determining a critical depth of cut for each of a plurality of control points defined on at least a second rolling element having substantially the same radial location as one of the intersection points, and determining a bit critical depth of at the radial locations of the intersection points as the minimum of critical depths of cut for each of the control points on each of the first and second rolling elements provided to each of the intersection points. The plurality of intersection points may include an intersection point defined on all of the fixed cutters located on the bit face that each include at least a portion of their cutting edges at the same radial location as a corresponding control point. In some embodiments, the method further includes projecting the operational forces into at least one of a bit coordinate system and a hole coordinate system.

According to another aspect, the disclosure is directed to a drill bit including a bit body defining a rotational axis about which the bit body rotates. A bit face is defined at a leading end of the bit body and a first rolling element is disposed on the bit face. The first rolling element defines a top surface along a generally cylindrical body thereof, and the top surface defines a first radial interval of the bit face. A first cutting element is defined on the bit face, and the first cutting element has a cutting edge extending at least partially into the first radial interval on the bit face. A position and orientation of the first rolling element on the bit face is configured to maintain at least three distinct contact zones between the top surface and a geologic formation to control a depth of cut associated with the first cutting element.

In some example embodiments, the drill bit further includes at least a second cutter having a cutting edge extending at least partially into the first radial interval, and the depth of cut may be controlled by the first rolling element is based on at least the first and second cutters. The drill bit may further include a second rolling element on the bit face, and the second rolling element may define a second radial interval overlapping a portion of the first radial interval into which the cutting edge of the first cutting element extends. In one or more example embodiments, the first cutting element may be a fixed cutting element on the bit face.

In another aspect, the disclosure is directed to a method of configuring a rolling depth of cut controller (RDOC) of a drill bit. The method includes (a) determining a desired minimum depth of cut for a radial interval defined on a bit face of the drill bit, (b) identifying all cutting elements located on the bit face that each include a cutting edge defined at least a partially within the radial interval, (c) determining a radial position of a rolling element of the depth of cut controller within the radial interval, the rolling element defining a cylindrical body, (d) identifying a number of contact zones existing along a top surface of the rolling element in an initial position and orientation based on the desired minimum depth of cut and each of the cutting edges defined at least a partially within the radial interval, and (e) determining a final an axial position, an angular position and an orientation of the rolling element based on the number of contact zones identified.

In some example embodiments, the number of contact zones existing along the top surface of the rolling element is at least three contact zones. In one or more example embodiments, the method further includes determining the final axial position, angular position and orientation of the rolling element based on a moment acting on the rolling element due to operational forces applied to the rolling element at the contact zones.

Therefore, the disclosed systems and methods are well adapted to attain the advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A method of configuring a rolling depth of cut controller (RDOCC) of a drill bit, the method comprising:

selecting a position and an orientation for a first rolling element of the RDOCC on a bit face of a drill bit, the first rolling element defining a top surface along a generally cylindrical body thereof;

establishing a set of design variables associated with the position, the orientation and a shape of the first rolling element;

calculating a critical depth of cut for a plurality of control points along the top surface of the first rolling element using the design variables;

identifying a number of contact zones existing along the top surface of the rolling element from the critical depth of cut calculated;

determining an engagement area and associated force magnitudes of operational forces acting on the rolling element for each of the contact zones identified;

ascertaining a moment acting on the rolling element from the force magnitudes determined; and comparing the force magnitudes and the moment to predetermined limits.

2. The method according to claim 1, wherein identifying the number of contact zones existing along the rolling element length of the rolling element includes identifying at least two distinct contact zones on opposite lateral sides of a rolling center of the first rolling element.

3. The method according to claim 2, wherein identifying the number of contact zones includes identifying at least three distinct contact zones.

4. The method according to claim 3, further comprising:

identifying a number of contact zones existing along the top surface of the first rolling element that includes less than three distinct contact zones;

changing at least one of the design variables to establish an adjusted set of design variables; and recalculating the critical depth of cut for the plurality of control points along the top surface of the first rolling element using the adjusted set of design variables.

5. The method according to claim 4, wherein changing at least one of the design variables includes changing at least one of an adjusted profile angle and an adjusted angular position of the first rolling element defining an orientation of the first rolling element on the drill bit.

6. The method according to claim 1, further comprising:

deciding that at least one of the force magnitudes and the moment are outside the predetermined limits; and changing at least one of the design variables to establish an adjusted set of design variables.

7. The method according to claim 1, further comprising:

determining a plurality of intersection points associated with cutting edges of fixed cutters on the bit face, each of the plurality of intersection points having substantially the same radial location as one of the control points; and calculating a critical depth of cut provided by each of the control points to each of the intersection points based on differences in position defined between the control points and the intersection points.

8. The method according to claim 7, further comprising determining a critical depth of cut for each of the control points as a maximal of the depths of cut provided to each of the intersection points by each of the control points.

9. The method according to claim 8, further comprising:

determining a critical depth of cut for each of a plurality of control points defined on at least a second rolling element having substantially the same radial location as one of the intersection points; and determining a bit critical depth of at the radial locations of the intersection points as the minimum of critical depths of cut for each of the control points on each of the first and second rolling elements provided to each of the intersection points.

10. The method according to claim 7, wherein the plurality of intersection points includes an intersection point defined on all of the fixed cutters located on the bit face that each include at least a portion of their cutting edges at the same radial location as a corresponding control point.

11. The method of claim 1, further comprising projecting the operational forces into at least one of a bit coordinate system and a hole coordinate system.

12. A drill bit comprising:

a bit body defining a rotational axis about which the bit body rotates;

a bit face defined at a leading end of the bit body;

a first rolling element on the bit face, the first rolling element defining a top surface along a generally cylindrical body thereof, the top surface defining a first radial interval of the bit face; and a first cutting element defined on the bit face, the first cutting element having cutting edge extending at least partially into the first radial interval on the bit face;

wherein a position and orientation of the first rolling element on the bit face is configured to maintain at least three distinct contact zones between the top surface and a geologic formation to control a depth of cut associated with the first cutting element.

13. The drill bit according to claim 12, further comprising at least a second cutter having a cutting edge extending at least partially into the first radial interval, wherein the depth of cut controlled by the first rolling element is based on at least the first and second cutters.

14. The drill bit according to claim 12, further comprising a second rolling element on the bit face, the second rolling element defining second radial interval overlapping a portion of the first radial interval into which the cutting edge of the first cutting element extends.

15. The drill bit according to claim 12, wherein the first cutting element is a fixed cutting element on the bit face.

16. A method of configuring a rolling depth of cut controller (RDOC) of a drill bit, the method comprising:

determining a desired minimum depth of cut for a radial interval defined on a bit face of the drill bit;

identifying all cutting elements located on the bit face that each include a cutting edge defined at least a partially within the radial interval;

determining a radial position of a rolling element of the depth of cut controller within the radial interval, the rolling element defining a cylindrical body;

identifying a number of contact zones existing along a top surface of the rolling element in an initial position and orientation based on the desired minimum depth of cut and each of the cutting edges defined at least a partially within the radial interval; and determining a final an axial position, an angular position and an orientation of the rolling element based on the number of contact zones identified.

17. The method according to claim 16, wherein the number of contact zones existing along the top surface of the rolling element is at least three contact zones.

18. The method according to claim 17, further comprising determining the final axial position, angular position and orientation of the rolling element based on a moment acting on the rolling element due to operational forces applied to the rolling element at the contact zones.

* * * * *